US010684106B2

(12) United States Patent
Gray et al.

(10) Patent No.: US 10,684,106 B2
(45) Date of Patent: Jun. 16, 2020

(54) AERODYNAMICALLY CONTOURED SPINNABLE PROJECTILE

(71) Applicants: Michael William Gray, Bloomfield Hills, MI (US); Ariana Gray, Bloomfield Hills, MI (US)

(72) Inventors: Michael William Gray, Bloomfield Hills, MI (US); Ariana Gray, Bloomfield Hills, MI (US)

( * ) Notice: Subject to any disclaimer, the term of this patent is extended or adjusted under 35 U.S.C. 154(b) by 0 days.

(21) Appl. No.: 16/104,003

(22) Filed: Aug. 16, 2018

(65) Prior Publication Data

US 2020/0056865 A1 Feb. 20, 2020

(51) Int. Cl.
*F42B 10/28* (2006.01)
*F42B 5/02* (2006.01)

(52) U.S. Cl.
CPC ..... *F42B 10/28* (2013.01); *F42B 5/02* (2013.01)

(58) Field of Classification Search
CPC ..... F42B 10/00; F42B 10/02; F42B 10/26; F42B 10/28; F42B 10/22; F42B 10/32; F42B 10/38
USPC ..... 102/439
See application file for complete search history.

(56) References Cited

U.S. PATENT DOCUMENTS 2,014,367 A * 9/1935 Breegle ..... F42B 5/045 102/436
2,573,362 A * 10/1951 Rouse ..... F42B 5/045 102/436
3,062,145 A * 11/1962 Morgan ..... F42B 7/10 102/436
3,063,376 A * 11/1962 Powell ..... F42B 10/26 244/3.23
3,452,677 A * 7/1969 Abela ..... F42B 7/10 102/436
4,301,733 A * 11/1981 Arciniega Blanco ... F42B 10/24 102/517
4,517,897 A * 5/1985 Kneubuhl ..... B21K 1/025 102/439
4,674,706 A * 6/1987 Hall ..... F42B 10/44 102/489
4,742,774 A * 5/1988 Flatau ..... F42B 10/34 102/439
4,958,570 A 9/1990 Harris
5,058,503 A * 10/1991 Adams, III ..... F42B 10/42 102/439
5,092,246 A * 3/1992 Huerta ..... F42B 12/08 102/439
5,133,261 A * 7/1992 Kelsey, Jr. ..... F42B 10/22 102/439
5,404,815 A 4/1995 Reed
(Continued)

FOREIGN PATENT DOCUMENTS

WO 2017191141 11/2017

*Primary Examiner* — Joshua E Freeman
(74) *Attorney, Agent, or Firm* — Brooks Kushman P.C.

(57) ABSTRACT

A projectile for use in a cartridge having a longitudinal axis, a leading end region, a trailing end region, and a chamber therebetween. The projectile is mounted in the leading end region and has a base. The base of the projectile is provided with one or more aerodynamically contoured features that receive forces generated by a propellant. The aerodynamically contoured features are concave or convex or are a combination of concave and convex so that some of the forces produce forwardly directed and rotational motion of the projectile.

17 Claims, 3 Drawing Sheets

(56) References Cited

U.S. PATENT DOCUMENTS

| | | | | | |
|---|---|---|---|---|---|
| 5,408,931 | A * | 4/1995 | Tallman | F42B 7/10 | 102/434 |
| 5,490,463 | A * | 2/1996 | Lamberty | F42B 5/025 | 102/430 |
| 6,439,125 | B1 | 8/2002 | Carter | | |
| 6,959,647 | B2 * | 11/2005 | Reynolds | F42B 5/26 | 102/430 |
| 6,971,315 | B2 * | 12/2005 | Knappworst | F42B 12/34 | 102/508 |
| 7,150,233 | B1 | 12/2006 | Eberhart | | |
| 7,219,607 | B2 * | 5/2007 | Oertwig | F42B 14/00 | 102/439 |
| 7,299,750 | B2 | 11/2007 | Schikora et al. | | |
| 7,302,891 | B1 * | 12/2007 | Adams | F42B 5/025 | 102/439 |
| 9,863,746 | B2 * | 1/2018 | Peterson | F42B 12/08 | |
| 2002/0134273 | A1 * | 9/2002 | Mihaylov | F42B 10/24 | 102/439 |
| 2007/0151474 | A1 * | 7/2007 | Widener | F42B 10/24 | 102/501 |
| 2011/0088537 | A1 | 4/2011 | Eberhart | | |
| 2016/0153757 | A1 * | 6/2016 | Mahnke | F42B 10/22 | 102/501 |
| 2017/0227339 | A1 * | 8/2017 | Adams | F42B 10/40 | |
| 2017/0314900 | A1 | 11/2017 | Mahnke | | |
| 2017/0322002 | A1 * | 11/2017 | Mahnke | F42B 10/22 | |
| 2018/0051967 | A1 * | 2/2018 | Schwark | F42B 30/02 | |

* cited by examiner

AERODYNAMICALLY CONTOURED SPINNABLE PROJECTILE

BACKGROUND OF THE INVENTION

(1) Field of the Invention

Several aspects of this disclosure generally relate to ammunition, e.g., cartridges with projectiles at their leading ends, missiles and other projectiles. More specifically, this disclosure relates to projectiles with an aerodynamically shaped base that translates the forces of propulsion into rotational and forwardly-directed motion so that the projectile spins as it travels through a barrel, thus improving the performance parameters of the projectile.

(2) Description of the Related Art

A typical cartridge has a projectile (bullet) at its leading end, a case, a propellant (e.g., gunpowder, compressed air, etc.) and a primer that ignites the propellant. In use, the projectile is expelled from a barrel of a gun or other firearm. The propellant behind the projectile generates forces that act on the projectile, thus expelling it through and out of the barrel.

A spinning effect tends to stabilize the projectile's trajectory. Traditionally, spin is imparted by a helical bore defined on the inside of the barrel. Ideally, such rifling is effective without distorting the projectile or damaging the bore of the barrel.

One problem with rifling is that it generates friction between the projectile and the barrel. In turn, such friction may over time cause deterioration of the bore of the barrel and deform its surface. Unless the bore is cleaned repeatedly, this phenomenon may result in diminished accuracy and barrel erosion, besides shortening the effective life of the firearm.

Improved projectile designs are desirable that impart spin to the projectile without excessive interaction between the projectile and the bore of its guiding barrel.

BRIEF SUMMARY OF THE INVENTION

In several embodiments, a projectile or bullet is provided that is adapted primarily for use in a cartridge. Conventionally, the cartridge has a projectile, a case, a primer and a propellant. For reference, the cartridge has a longitudinal axis, a leading end region, and a trailing end region. The projectile is mounted in the leading end region.

The projectile has one or more aerodynamically contoured features associated with the base that faces the chamber of the cartridge. Those features are impacted by forces exerted by a propellant in the chamber. Thus, defined in the base are one or more convex or concave aerodynamically contoured features that receive forces generated by a propellant. Such features are concave or convex or both in relation to a diametral lateral plane at the projectile base. The features are contoured so that propulsive forces are resolved in such a way as to impart a rotary (spinning) and forwardly-directed motion to the projectile. Such propulsive forces often are often explosive in nature, and may be gaseous (e.g., compressed air), or at least partially vaporous, or both.

In one embodiment, one or more of the aerodynamically contoured features are concave and are effectively defined by one or more pockets that receive the forwardly and radially directed force generated by the propellant. The pockets are contoured so that at least part of the forwardly and radially directed force is converted into rotational and forwardly directed motion of the projectile, so that the projectile spins about the longitudinal axis as it travels through and from a barrel of a firearm.

In another embodiment, one or more of the aerodynamically contoured features are convex and are effectively defined by one or more protrusions that receive the forwardly and radially directed force generated by the propellant. The protrusions are contoured so that at least part of the forwardly and radially directed force is converted into rotational and forwardly directed motion of the projectile, so that the projectile spins about the longitudinal axis and it is projected forwardly, often through a barrel.

In yet another embodiment, the projectile base has concave and convex aerodynamically features that combine to impart a spinning motion to the projectile while directing it forwardly.

Other technical advantages may become apparent to one ordinarily skilled in the art after review of the following Figures and description.

DETAILED DESCRIPTION

Figure 1:
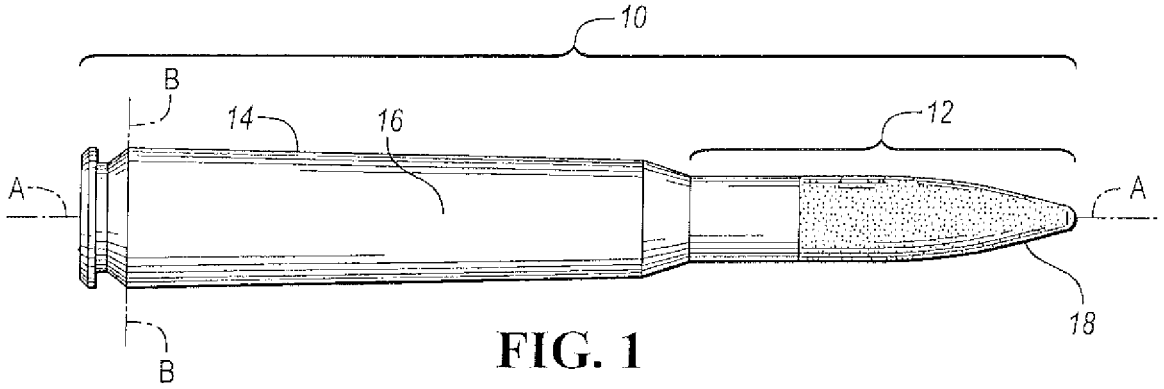
FIG. 1 depicts a cartridge containing a projectile according to one embodiment of the present disclosure.
Figure 2:
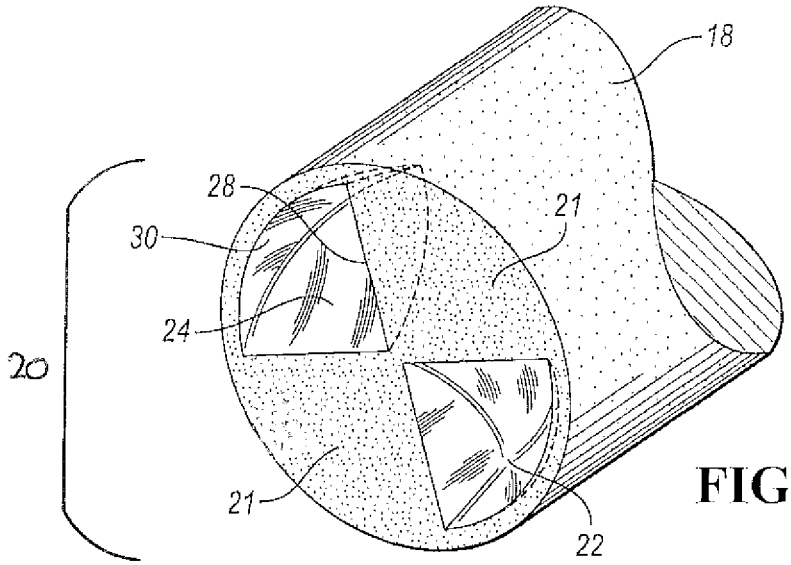
FIG. 2 is a perspective, partially sectioned view of one embodiment of a projectile with aerodynamically contoured concave features provided in its base; in this case, two features are depicted, but in other embodiments, one or more of such features are contemplated.

Although specific advantages have been enumerated above, various embodiments may include some, none, or all the enumerated advantages.

It should be understood at the outset that, although exemplary embodiments are illustrated in the Figures and described below, the principles of the present disclosure may be implemented using any number of techniques, whether currently known or not. The present disclosure should in no way be limited to the exemplary implementations and techniques illustrated in the drawings and described below.

Unless otherwise specifically noted, articles depicted in the drawings are not necessarily drawn to scale.

Modifications, additions, or omissions may be made to the systems, apparatuses, and methods described herein without departing from the scope of the disclosure. For example, the components of the apparatuses may be integrated or separated. Moreover, the operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set.

In one embodiment as depicted in FIG. 1, a cartridge 10 is provided for reference with an imaginary longitudinal axis A-A and a lateral axis B-B that lies in a base 20 of a projectile 18 that is disposed in the cartridge 10. The cartridge 10 has a leading end region 12, a trailing end region 14, and a chamber 16 therebetween. The projectile 18 is mounted in the leading end region 12.

Conventionally, a propellant (not shown) is contained in the chamber 16 and a primer is often provided in the trailing end region 14, which ignites the propellant.

To translate the forces exerted by the propellant in the chamber 16 into rotary and forwardly directed motion of the projectile 18, the projectile base 20 is provided with one or more aerodynamically contoured features 22. These aerodynamically contoured features 22 receive forwardly and radially directed force generated by the propellant.

Such features 22 may be concave, convex or both. The concave form 23 of feature 22 will first be discussed.

In one embodiment, such one or more features 23 are concave (see, e.g., FIGS. 2, 3A, 3B, 4, 5A, 5B & 6A). As used herein, the term "concave" is meant to include a pocket, a slit, a groove, a trough, an inclining ramp surface, a declining ramp surface, and an airfoil that individually or collectively may be straight or curved. As an example, a concave feature 23 may be in the form of a pocket that represents an alteration of an otherwise smooth projectile base 20. Such a pocket may be provided with a sloped surface 24 that effectively forms a leading surface of the associated aerodynamic contour. In one configuration, the sloped surface 24 may lie between a curved sidewall 30 and an end wall 28. It will therefore be appreciated that the concave feature 23 may assume the shape of a slit, groove, trough or another indented feature. Regardless of the configuration of the concave feature, its main purpose is to engage propulsive forces and distribute them at least partially into spinning or rotational forces that are exerted on the projectile base 20.

The forces associated with the propellant are directed towards the one or more concave features 23 which are contoured so as to receive an incident propulsive force and translate at least part of it into rotary motion so that the projectile 18 spins about the axis A-A as it travels forwardly. In one case, a concave feature 22 has a declining, curved ramp surface 24 and an end wall 28 that receive the forwardly and radially directed force generated by the propellant. Thus, the propellant forces are resolved into a longitudinal component and a radial component. Such forces produce a forwardly directed motion of the projectile and a rotational (spinning) effect due to the impact of propulsive forces upon the aerodynamically contoured concave or convex features (to be discussed below). The longitudinal component urges the projectile 18 to be expelled for example from the bore of an associated barrel of a firearm, missile or the like. The rotary component exerts a turning effect on each concave feature 22 in the projectile base 20 so that the projectile 18 spins, regardless of whether the bore includes rifling.

In one form of concave aerodynamically contoured feature 23, the incident ramp surface 24 is contoured so that at least part of the forwardly directed force is converted into rotational motion of the projectile 18 so that the projectile may spin about the longitudinal axis A-A as it travels through and exits from a barrel.

Figure 3A:
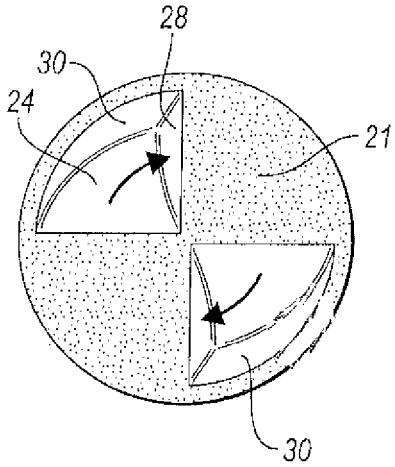
FIG. 3A is an end view of one embodiment of a projectile base with two aerodynamically contoured concave features that are configured to impart a clockwise spinning effect; in this case, two features are depicted, but in other embodiments, one or more of such features are contemplated.
Figure 3B:
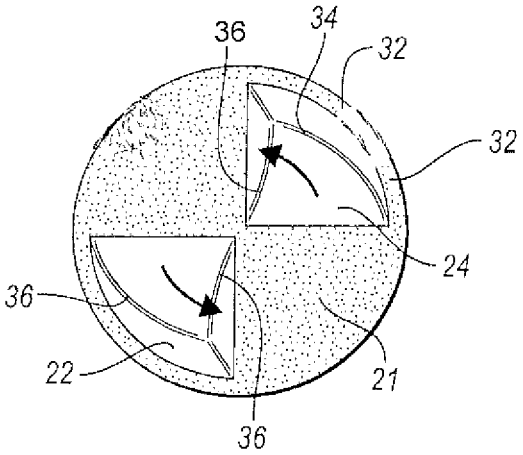
FIG. 3B is an end view of one embodiment of a projectile base with two aerodynamically contoured concave features configured to impart a counterclockwise spinning effect; in this case, two features are depicted, but in other embodiments, one or more of such features are contemplated.
Figure 4:
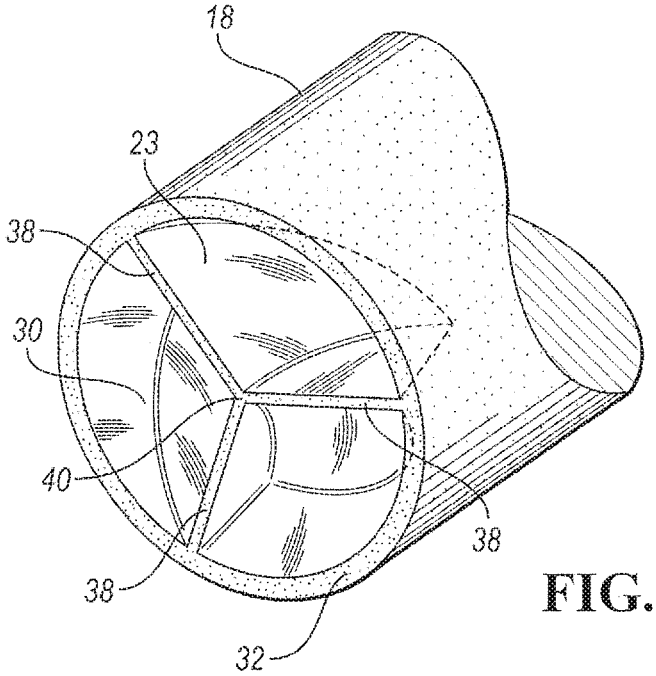
FIG. 4 is a perspective, partially sectioned view of a projectile with three aerodynamically contoured concave features provided in its base according to one embodiment of the present disclosure.
Figure 5A:
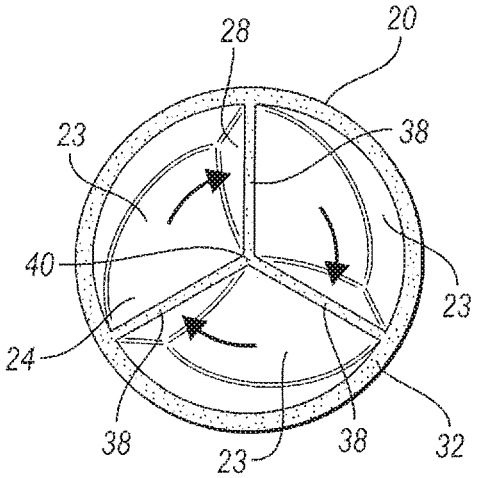
FIG. 5A is an end view of a projectile base with three aerodynamically contoured concave features configured to impart a clockwise spinning effect.
Figure 5B:
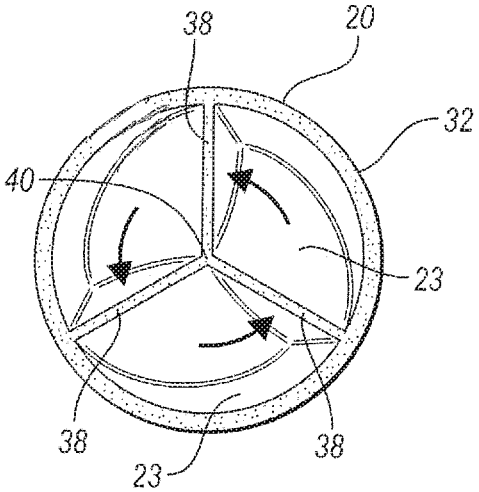
FIG. 5B is an end view of a projectile base with three aerodynamically contoured concave features configured to impart a counterclockwise spinning effect.

In one embodiment (see, e.g., FIG. 2) lands or plateaus 21 lie in the projectile base 20 between at least some of the aerodynamically contoured features 22. The lands 21 may lie in a diametral plane that includes axis B-B orthogonal to the longitudinal axis A-A. Alternatively, they may be sloped or inclined to a diametral plane in such a way as to augment the rotary component of forces generated by the propellant. In another embodiment, a concave aerodynamically contoured feature 23 may be formed by a declining, curved ramp surface 24, a wall 28 at an end thereof and a curved sidewall 30 (FIG. 3A). That curved sidewall 30 has an upper edge 32 (FIG. 3B) that terminates in the projectile base 20, a lower edge 34 that terminates in the ramp surface 24 and a quasi-radial edge 36 that terminates in a foot of the end wall 28.

In practice, for aerodynamic efficiency, there may be a smooth transition between a bottom region of the ramp surface 24 and the wall 28 and/or the curved sidewall 30. Similarly, there may be provided a smooth transition between the lower edge 34 and the ramp surface 24.

In other illustrative embodiments (FIGS. 4, 5A & 5B) of the concave variety 23 of aerodynamic feature 22, three of such concave features are depicted. They are separated at the projectile base 20 by radial fins 38 (FIGS. 4-5B) which effectively serve as the leading edges of associated airfoil blade surfaces. Those edges or radial fins 38 radiate outwardly from a central portion 40 of the projectile base 20. Although depicted as extending linearly, those edges 38 may in some embodiments be curved (see, e.g., FIG. 7). The degrees of curvature may change from assuming a relatively linear radial section close to the central portion 40 to a more tangentially oriented section as the edge 38 comes closer to the projectile sidewall 32 (or vice-versa), like the blades of some jet engines.

If desired, the central portion 40 may be raised above a diametral plane and serve like the nose of a propeller.

If desired, the leading edges 38 of the radial fins may be sharpened to some degree to facilitate the separation of incident forces downwardly into the aerodynamically contoured concave features 23.

The turning effect of propulsive forces may be augmented by providing a radial plane of one or more walls 28 (FIG. 1) that is inclined to the longitudinal axis A-A so that the walls can effectively serve as one-sided airfoil.

Figure 6A:
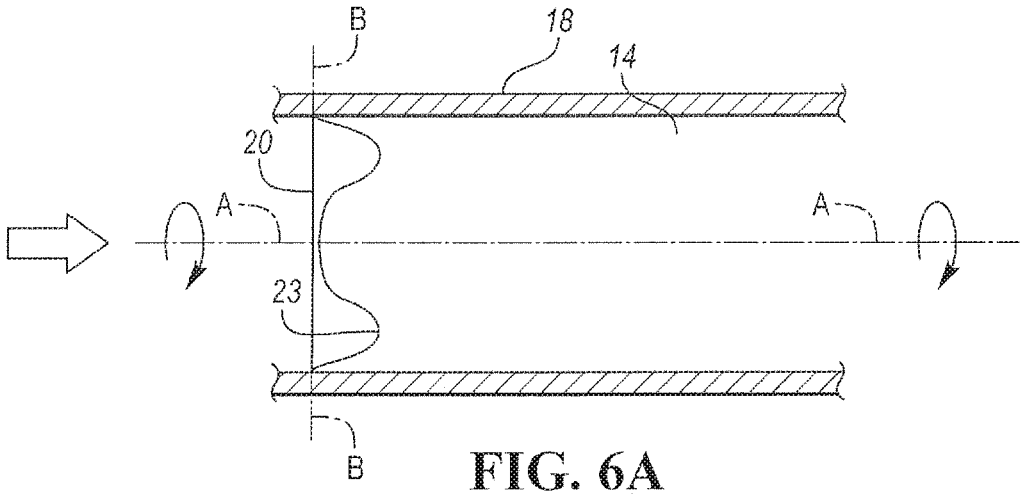
FIG. 6A is a cross-sectional view of a trailing end region of the cartridge with an illustrative pair of concave aerodynamic features defined therein.
Figure 6B:
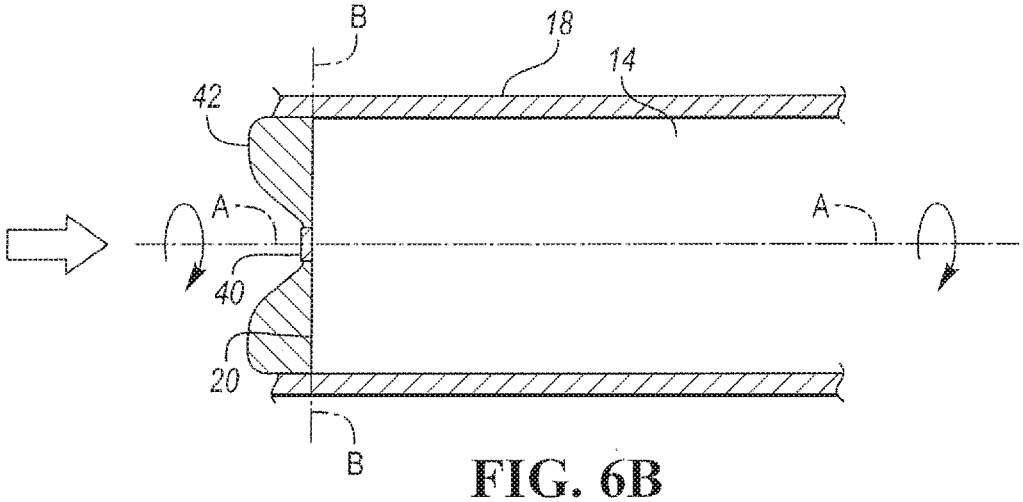
FIG. 6B is a cross-sectional view of a trailing end region of the cartridge with an illustrative pair of convex aerodynamic features defined therein.
Figure 7:
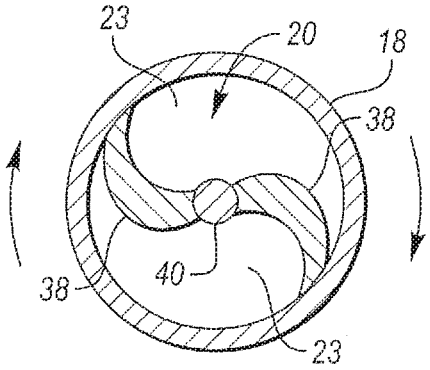
FIG. 7 is an end view of one embodiment of a projectile base with curved aerodynamic features that may be concave or convex.

The disclosure now turns to illustrative convex forms 42 of aerodynamically contoured features (see, e.g., FIGS. 6B, 7).

In one alternative embodiment (see, e.g., FIG. 7), there may be a leading edge or radial fin 38 that extends across the projectile base 20. In that case, there are two aerodynamically contoured concave features 23, one on either side of the leading edge or radial fin 38. Again, that leading edge or radial fin 38 may be curved (as shown) or straight. Alternatively, (in a concave feature 23) there may be cut slits on grooves in place of the radial fin 38. Such slits or grooves may be radially or tangentially oriented and may be formed by an incision that is inclined to the axis B-B (FIG. 6A). Their depth may be uniform or non-uniform. Those slits or grooves can be oriented to induce clockwise or counter-clockwise rotation.

In one convex embodiment, such one or more features 42 protrude at least partially above the projectile base 20 (see, e.g., FIG. 6B). The forces associated with the propellant are directed towards the one or more convex features 42 which are contoured so as to receive an incident propulsive force and translate at least part of it into rotary motion so that the projectile 18 is propelled outwardly along and spins about the axis A-A. In one case, a convex feature 42 has an incident surface that is shaped like an airfoil and is partially embedded in the projectile base 20. This feature 42 receives the forwardly and radially directed force generated by the propellant. Thus, the propellant forces are resolved into a longitudinal component and a radial component. Such forces produce a forwardly directed motion of the projectile and a rotational (spinning) effect. The longitudinal component urges the projectile 18 forwardly. The rotary component exerts a turning effect on each convex feature 42 in the projectile base 20 so that the projectile 18 spins, regardless of whether the bore of an associated barrel includes rifling.

For a given barrel, a projectile's spin characteristics can be tailored to a specific need by reconfiguring the shape and number of aerodynamically shaped aerodynamically contoured features. Further, costs can be saved by obviating the need for rifling in the bore of the gun barrel.

In many ways, these and other embodiments offer improvements over conventional projectiles. Several projectiles of the types described provide an adjustable and cost-saving design over conventional missiles or projectiles. The disclosed projectile may for example have one or more concave or convex or both aerodynamically contoured features that redeploy propulsive forces into longitudinally directed and rotary forces. This enhances the projectile's performance because its spin rate is potentially augmented.

As described herein, the disclosed projectile spins following exposure to a high-force propellant that translates the force into forwardly and rotationally directed energy via the aerodynamically contoured features. One result is that the projectile is stabilized and its trajectory becomes known with more precision.

If desired, the projectile can be employed over a range of barrel diameters.

In several cases, the present disclosure can be used with barrels having a smooth bore, grooves or rifling or both. Smooth barrels may be associated with decreased barrel friction because friction is minimized between the projectile and the bore. Such reduced friction can allow higher projectile velocities and decreased barrel wear. This may be helpful in the design of automatic weapons, in which the firearm may become overheated in use. Other things being equal, reduced friction leads to less heat being generated. If desired, it therefore becomes possible to prolong the duration of continuous firing.

It will be appreciated that this disclosure is not limited to projectiles that pass through smooth barrels. Where present, rifling is the helical groove pattern that is machined into the internal surface (bore) of a gun's barrel, for the purpose of exerting torque and thus imparting a spin to a projectile around its longitudinal axis during shooting. See, e.g., https://en.wikiedia.org/wiki/Rifling. This spin serves to gyroscopically stabilize the projectile by conservation of angular momentum, improving its aerodynamic stability and accuracy over smoothbore designs. Id. Rifling is often described by its twist rate, which indicates the distance the rifling takes to complete one full revolution, such as "1 turn in 10 inches" (1:10 inches), or "1 turn in 254 mm" (1:254 mm). Id. A shorter distance indicates a "faster" twist, meaning that for a given velocity the projectile will be rotating at a higher spin rate. Id. In combination with the disclosed aerodynamic features 22, rifling can be used to boost the spin rate of the projectile and thus enhance the projectile's trajectory as it exits the barrel.

In some cases, the disclosed projectile may be made from advanced materials that can retain their integrity under the forces exerted by the propellant while not sacrificing dimensional tolerances between the projectile and the gun barrel. As an example, parts of the projectile may use a fiber-reinforced composite. In other cases, the projectile may be made from such materials as carbon fiber or a high strength steel. In other cases, the internal chamber may expand to fit the barrel and may include plastic resin, copper alloys, aluminum, and like materials.

LIST OF REFERENCE NUMERALS

| Reference No. | Component |
|---|---|
| 10 | Cartridge |
| 12 | Leading end region of cartridge |
| 14 | Trailing end region of cartridge |
| 16 | Chamber |
| 18 | Projectile |
| 20 | Projectile base |
| 22 | Aerodynamically contoured features - concave or convex |
| 23 | Concave feature |
| 24 | Ramp surface |
| 28 | End wall |
| 30 | Curved sidewall |
| 32 | Upper edge |
| 34 | Lower edge |
| 36 | Quasi-radial edge |
| 38 | Edges or radial fins |
| 40 | Central portion |
| 42 | Convex feature |

What is claimed is:

1. A cartridge with a longitudinal axis, a leading end region, a trailing end region, and a chamber therebetween, the cartridge having:

a. a projectile mounted in the leading end region, the projectile having a base;

b. a propellant in the chamber;

c. the base of the projectile being provided with one or more aerodynamically contoured features that are separated by lands, such features being radially arranged about the longitudinal axis and receive forces generated by the propellant, at least some of the forces being resolved into rotational motion of the projectile so that the projectile may spin about the longitudinal axis;

wherein at least some of the one or more concave aerodynamically contoured features are concave and include a pocket with i. a ramp surface, a sidewall and an end wall that receive the forces generated by the propellant; ii. the pocket being contoured so that at least some of the forces generated by the propellant produce rotational motion of the projectile.

2. The cartridge of claim 1, wherein the one or more aerodynamically contoured features are concave features.

3. The cartridge of claim 2, wherein the base of the projectile has a central region around which the one or more aerodynamically contoured features are radially arranged.

4. The cartridge of claim 2, wherein the concave features are configured so that the projectile spins in a clockwise direction.

5. The cartridge of claim 2, wherein the concave features are configured so that the projectile spins in a counterclockwise direction.

6. The cartridge of claim 2, wherein the lands lie in the base between at least some of the aerodynamically contoured concave features, the lands lying in a diametral plane or are inclined to a diametral plane in such a way as to augment the rotary component of forces generated by the propellant.

7. The cartridge of claim 2 wherein the aerodynamically contoured features are separated at the projectile base by radial fins which effectively serve as leading edges of associated blade surfaces, the leading edges radiating outwardly from a central portion of the base.

8. The cartridge of claim 7, wherein the leading edges of the radial fins are curved or straight.

9. The cartridge of claim 8, wherein the curved radial fin edges have degrees of curvature that transition from a relatively linear section close to the central portion of the base to a more tangentially oriented section as the fin edge approaches a curved sidewall.

10. The cartridge of claim 7, wherein the leading edges are sharpened to facilitate the direction of incident forces downwardly into the aerodynamically contoured concave features.

11. The cartridge of claim 7, wherein a radial wall extends across a diameter of the base to form a diametral wall, thereby providing two aerodynamically contoured concave features, one on each side of the diametral wall.

12. The cartridge of claim 2, wherein at least some of the concave features are slits or groves that may be straight or curved or be radially oriented.

13. The cartridge of claim 1, wherein the one or more aerodynamically contoured features are convex features.

14. The cartridge of claim 13, wherein one or more of the convex aerodynamically contoured features are defined by one or more protrusions from the projectile base that receive forwardly and radially directed forces generated by the propellant, the one or more protrusions being contoured so that at least part of the forwardly and radially directed forces produce rotational and forwardly directed motion of the projectile, so that the projectile spins about the longitudinal axis.

15. The cartridge of claim 14, wherein the one or more convex aerodynamically contoured features have an incident surface that is shaped like an airfoil and is at least partially embedded in the projectile base.

16. The cartridge of claim 1, wherein a smooth transition is provided between the ramp surface and the end wall.

17. The cartridge of claim 1, wherein a smooth transition is provided between the ramp surface and the sidewall.

* * * * *